United States Patent [19]

Voss

[11] Patent Number: 4,901,419

[45] Date of Patent: Feb. 20, 1990

[54] A-FRAME WINDOW COVERING MOUNTING ARRANGEMENT

[75] Inventor: Robert J. Voss, Fountain Valley, Calif.

[73] Assignee: Home Fashions, Inc., Westminster, Calif.

[21] Appl. No.: 293,054

[22] Filed: Jan. 3, 1989

[51] Int. Cl.[4] ..... A47H 23/04

[52] U.S. Cl. ..... 29/412; 29/401.1; 160/84.1

[58] Field of Search ..... 29/91, 91.1, 412, 415, 29/401.1, 24.5; 83/13, 56, 701; 160/84.1

[56] References Cited

U.S. PATENT DOCUMENTS 4,518,025 5/1985 Judkins ..... 160/84.1

*Primary Examiner*—Joseph M. Gorski

*Attorney, Agent, or Firm*—George J. Netter

[57] ABSTRACT

A pleated fabric window covering for an angular top or ceiling wall has the pleated fabric upper part cut at the required angle and the pleat lines are cut from the angular edge inwardly a fixed distance forming tabs. The tabs are overlapped and stapled to the upper rail flat surface. Manipulation of control cords positions the pleated fabric at any desired location below the upper rail lower end.

5 Claims, 4 Drawing Sheets

FIG. 9
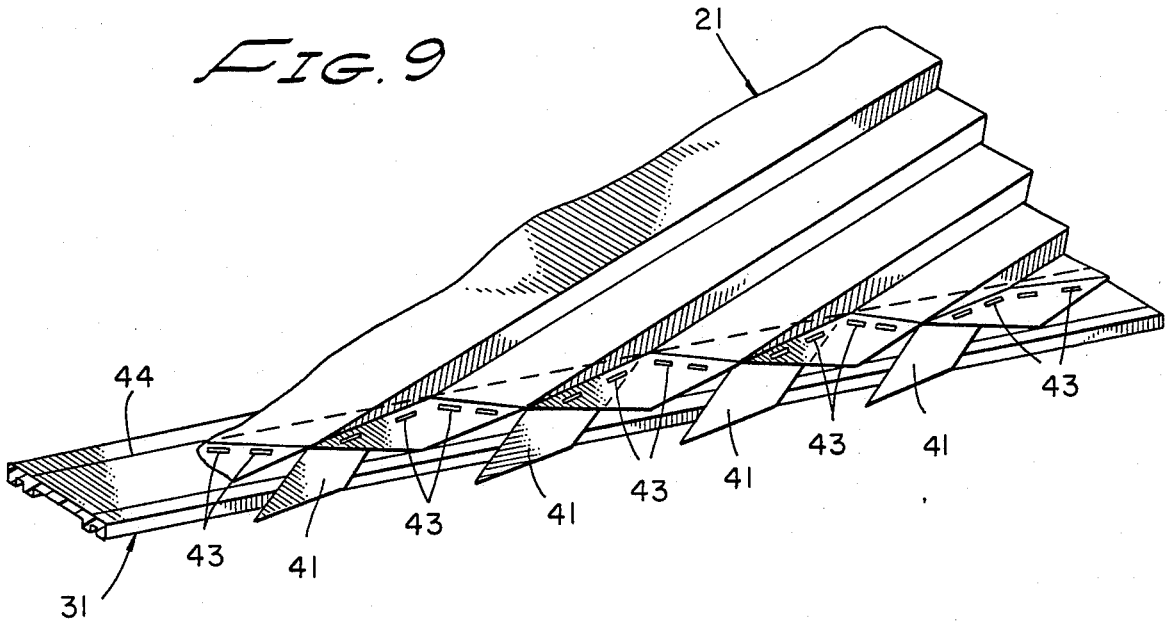
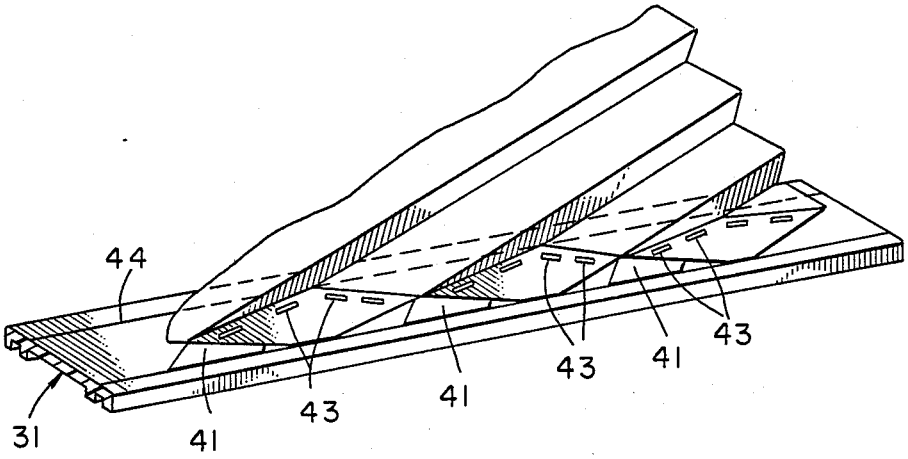
FIG. 10

A-FRAME WINDOW COVERING MOUNTING ARRANGEMENT

The present invention pertains to window coverings, and, more particularly, to a window covering for an area that has an angular top wall to be covered, method of making and a mounting arrangement therefor.

BACKGROUND OF THE INVENTION

A window covering of the kind that is of particular interest here consists of a textile fabric or a pliable plastic material which is formed into a plurality of parallel pleats, and which on raising or lowering the material folds and unfolds along the pleat lines. In the usual situation, the wall portion to be covered is substantially rectangular so that the wall covering itself is rectangular and readily moved vertically between open and closed positions in conventional manner.

There are many situations in which a window, for example, has an upper edge which is arranged at an angle to the horizontal, or other situations where the ceiling may be canted at an angle so that a wall covering to conform to a space to be covered must have an upper edge that is similarly arranged at an angle to the horizontal. Such a wall covering is frequently referred to as an "A-frame" covering and when the term is used herein it will be in that sense.

An A-frame wall covering, since it has an upper edge that is angularly disposed to the horizontal, can only be raised to the lowermost end of the angled upper edge. Moreover, the portion of the covering or blind between the two ends of the angled edge remain in extended position throughout use which presents a difficult fabrication problem in securing the angled cut edge of the covering fabric to the angularly disposed head rail to which the covering is attached without puckering, tearing or otherwise distorting the material. In the past, interconnections between the fabric portion of the covering to the angularly disposed headrail have been a relatively difficult hand operation which frequently resulted in a puckered interconnection point or series of points that were both unsightly and not fully reliable.

SUMMARY OF THE DISCLOSURE

Initially the pleated fabric is cut and drilled in accordance with the overall length desired for the particular final window covering, shade or blind. Two inner rails and one bottom rail are cut to the proper width of the covering and a headrail is also cut to the angle of width. The fabric is then stapled or otherwise secured to the two inner rails previously sized to width.

An inspection rack slide temporarily holds the top inner rail which is received into a part of the slide and which is at least as wide as the shade or preferably wider. The window covering is then allowed to hang to its greatest length and stretched a slight additional amount. The adjustment cords are now cut to accommodate the window covering in the extended relation.

Next, the window covering fabric is marked measuring up from the bottom rail at its point of highest drop and also at the point of lowest drop, depending upon the required angle of the top edge. The window covering is then removed from the rack and laid flat on a suitable work surface where the fabric is flattened onto the surface in the area of the angle to be cut. A line is drawn by the use of a conventional straight edge from the point of highest drop to the point of lowest drop previously marked, and the fabric is cut along the line. A similar line is prepared using the other side of the straight edge (e.g., one inch width for the straight edge) so that there are now two parallel lines, one of which is the cut edge and the other is an angular line parallel to the cut edge. Each pleat or fold line is cut from the angular outer edge into the parallel line forming tabs in the fabric and each tab is folded and creased along the parallel angle line.

Starting from what is to be the top of the shade in final use, adjacent tabs are folded over one another forming a three-sided pleat for each adjacent pair. The inner rail is then positioned against an appropriately located limit stop With the fabric and parts described to this point laid on the work table, the fabric is held upside down but at the angle that it is to hang. The fabric tabs are then stapled to the inner rail parallel to foldline from the back side (e g., two staples per pleat) insuring that the points of the pleat do not go beyond the limit stop positioning of the inner rail. When all of the fabric is stapled to the rail, then the excess fabric tabs are trimmed off.

The cord holes are lined up and a hole is punched in the position needed. Some of the holes will be to the front of the fabric and some to the back depending upon hole location and angle of the cut. The cord guide may now be installed in each hole. As a final matter, masking tape may be placed over the exposed staples on the inner side of the inner rail, and with the cords fed through the cord guides, the A-frame window covering is completed.

DESCRIPTION OF THE DRAWINGS

FIG. 9 shows the tabs of the fabric stapled onto the inner rail.

FIG. 10 shows the stapled tabs trimmed to remove excess tabs.

DESCRIPTION OF A PREFERRED EMBODIMENT

Figure 1:
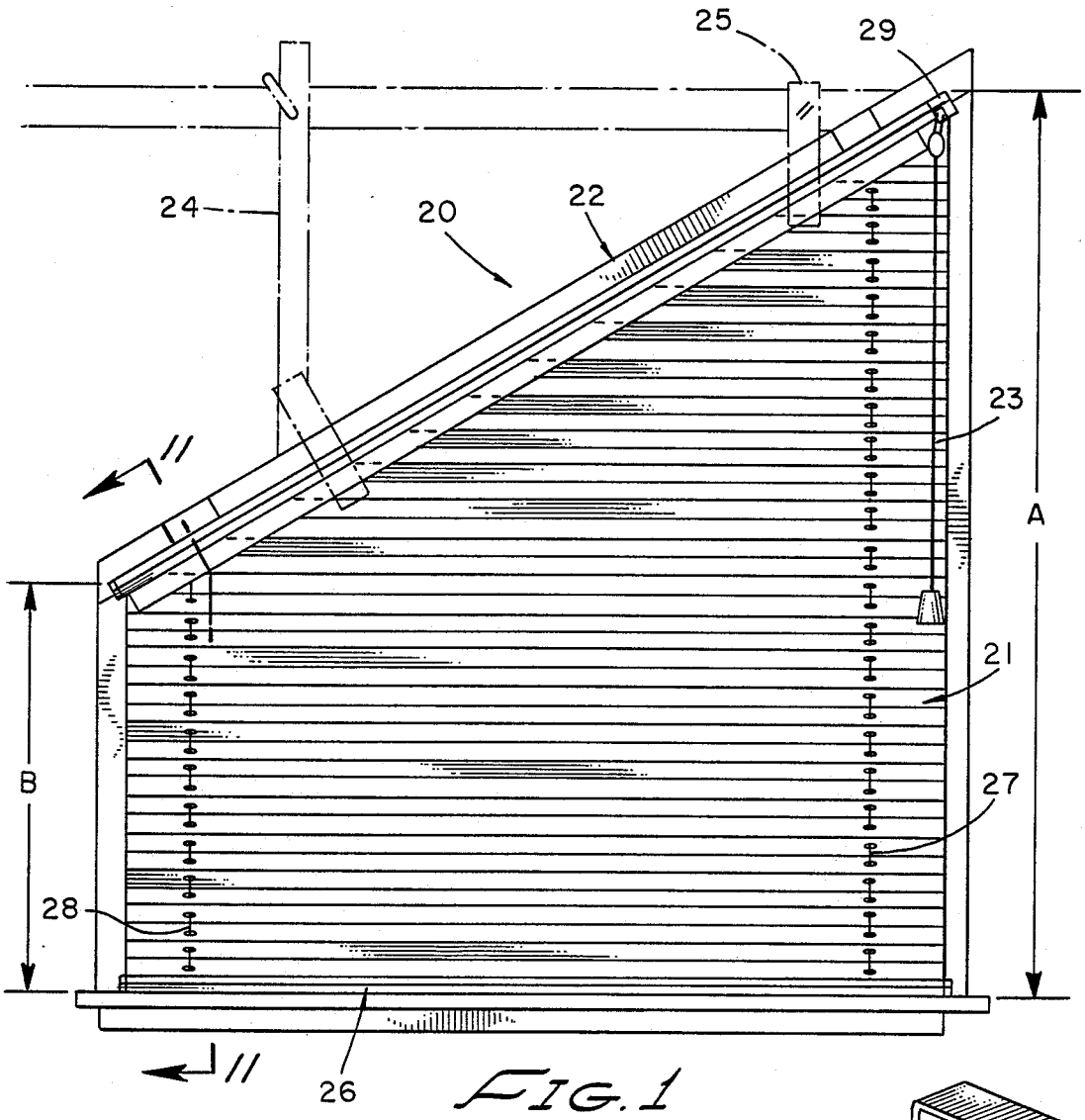
FIG. 1 is a side elevational view of the described window covering unit shown mounted onto a rack to simulate final mounting.

Turning now to the drawings and particularly FIG. 1, an A-frame wall covering unit the fabrication of which we are particularly concerned with here is identified generally as 20 and is seen to include in its major parts an extent of pleated fabric 21 hanging from an angularly disposed headrail 22, and an adjustment cord 23 which enables raising and lowering the pleated fabric 21, as desired. First and second brackets 24 and 25 (shown in dotted line) form a rack for use in manufacturing and inspection of completed window covering units in simulated final mounting.

The A-frame window covering unit differs from conventional window covering units employing a pleated fabric essentially in that the upper headrail 22, instead of being disposed in a generally horizontal position with respect to the hanging fabric, is arranged at an angle in order to accommodate an angular internal ceiling surface, or to align with and cover an angular window top, for example. Accordingly, at the right side there is depicted in FIG. 1 pleated fabric 21 extending upwardly a total distance of A which is greater than the distance B as measured along the left side. It is to be understood that the total amount of adjustment for the height of the pleated fabric that can be achieved by manipulation of the cord 23 cannot exceed the distance B, so that in the shade's highest adjustment position, the lowermost edge of the fabric (or rail 26) would be positioned at the top end of dimension B in contact with the lower left end of the rail 22.

Figure 2:
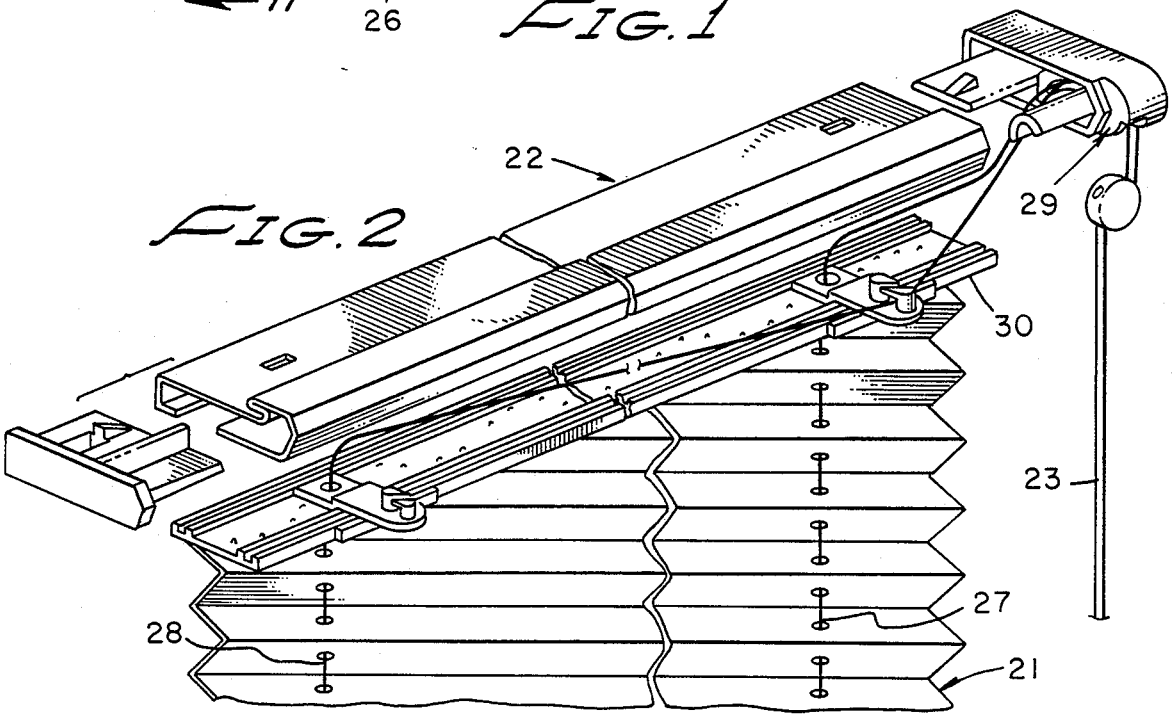
FIG. 2 is a perspective, partially fragmentary view showing parts of the headrail in exploded relation.

As can be seen best in FIG. 2, the adjustment cord 23 interconnects through the headrail to first and second cords 27 and 28 threaded through a plurality of aligned openings formed in the pleated fabric along two lines parallel to the right edge and to the left edge of the pleated fabric, respectively. Accordingly, by manipulation of the cord 23 each of the cords 27 and 28 are raised or lowered depending upon the adjustment direction of cord 23. A locking means 29, only represented schematically in FIG. 2, is of conventional design and permits the pleated fabric 21 to stay at any particular predetermined location until moved to a further location.

It is desirable that the pleated fabric in the region between the upper and lower edges of the canted headrail 22 be folded that amount necessary to appear continuous and consistent with the rest of the fabric as it hangs downwardly. This is accomplished as described herein in a manner that will also reliably secure the window covering fabric to the head rail from which it hangs and without exhibiting puckering or distortion of the partially folded fabric located between the two ends of the angularly disposed headrail.

Figure 3:
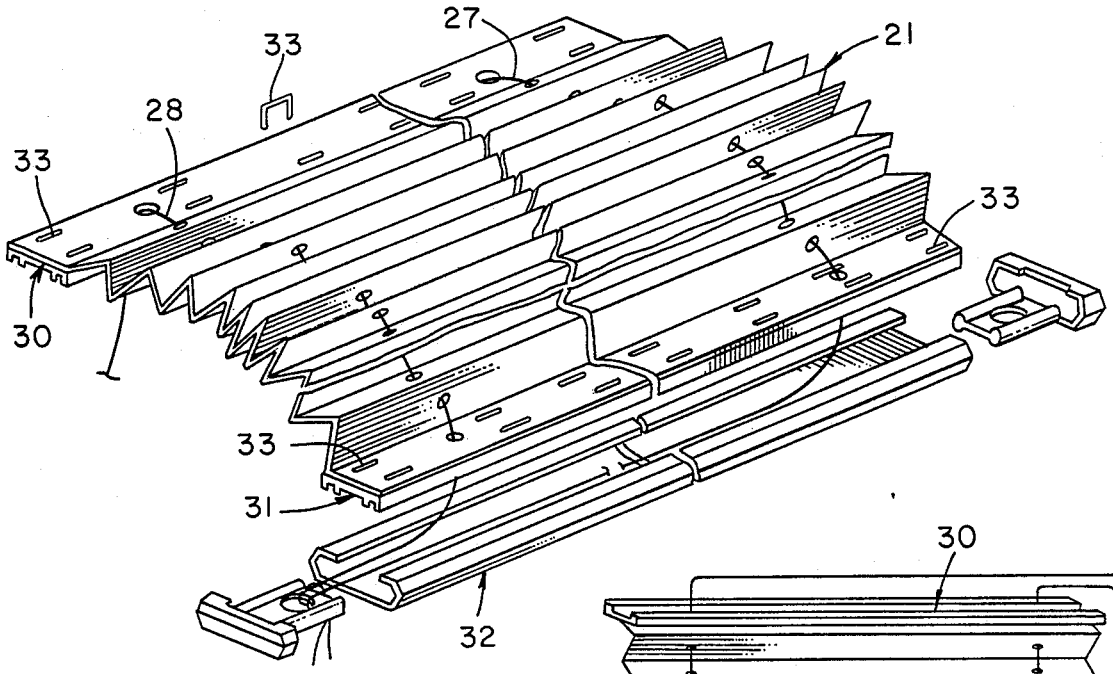
FIG. 3 is a perspective view of a rectangular window covering unit in a first stage for conversion to an A-frame.
Figure 4:
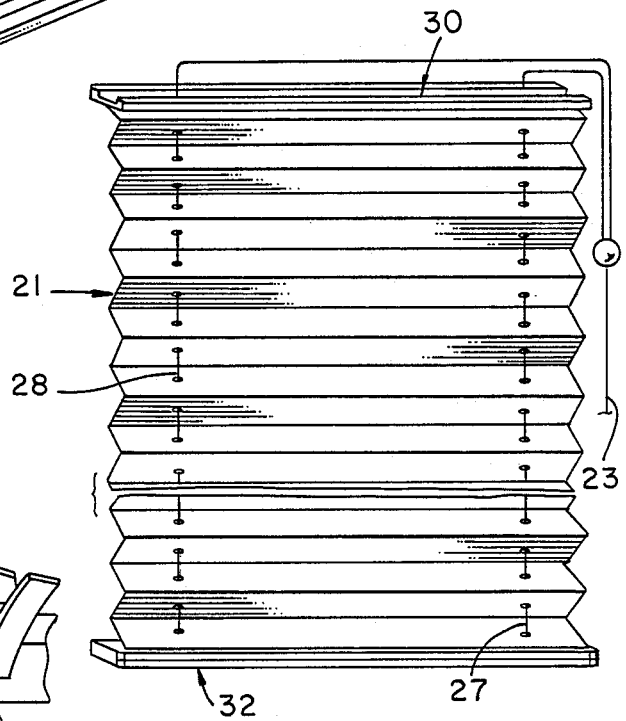
FIG. 4 is a front elevational view of the window covering unit of FIG. 3 shown fully extended.

As initial preparation for fabricating an A-frame window covering in accordance with this invention, two inner rails 30 and 31 and a bottom rail 32 are cut to the desired width of the final window covering unit or shade (FIG. 3). The opposite ends of the presized extent of fabric 21 is stapled (33) to the two properly dimensioned inner rails 30 and 31. As for a conventional shade, the fabric package is punched and grommeted to make it amenable for cording. The bottom rail is then assembled in the normal way to the inner rail except that the headrail and cord lock is not provided. The entire assembly to this point is shown in FIG. 4 extended vertically.

Figure 5:
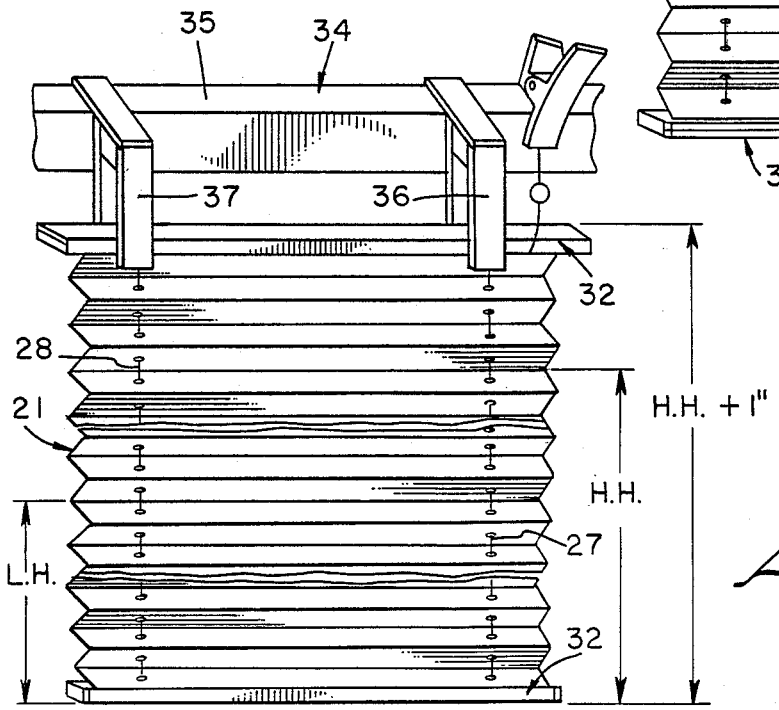
FIG. 5 is a front elevational view of the covering unit of FIG. 4 shown in a special hanging rack for marking the predetermined angle of the upper edge.

Turning now to FIG. 5 an inspection rack 34 generally includes an elongated rectangular member 35 which is conveniently mounted horizontally and has at spaced intervals first and second U-shaped hangers 36 and 37 onto which an inner rail may be slid in order to support the shade in hanging relation during further processing. In particular, the shade as shown in FIG. 5 has the rail 32 held by the hangers 36 and 37 allowing the shade to hang downwardly. The shade is extended to its maximum use length plus approximately one inch and the cords are clipped to maintain the shade at that overall height. With the shade in this hanging relation as depicted in FIG. 5, the lowest height of the shade is marked on the left in any suitable manner and on the right side the highest point is also marked (i.e., L.H. and H.H.). These two marks correspond to the dimensions B and A, respectively, shown in FIG. 1.

Figure 6:
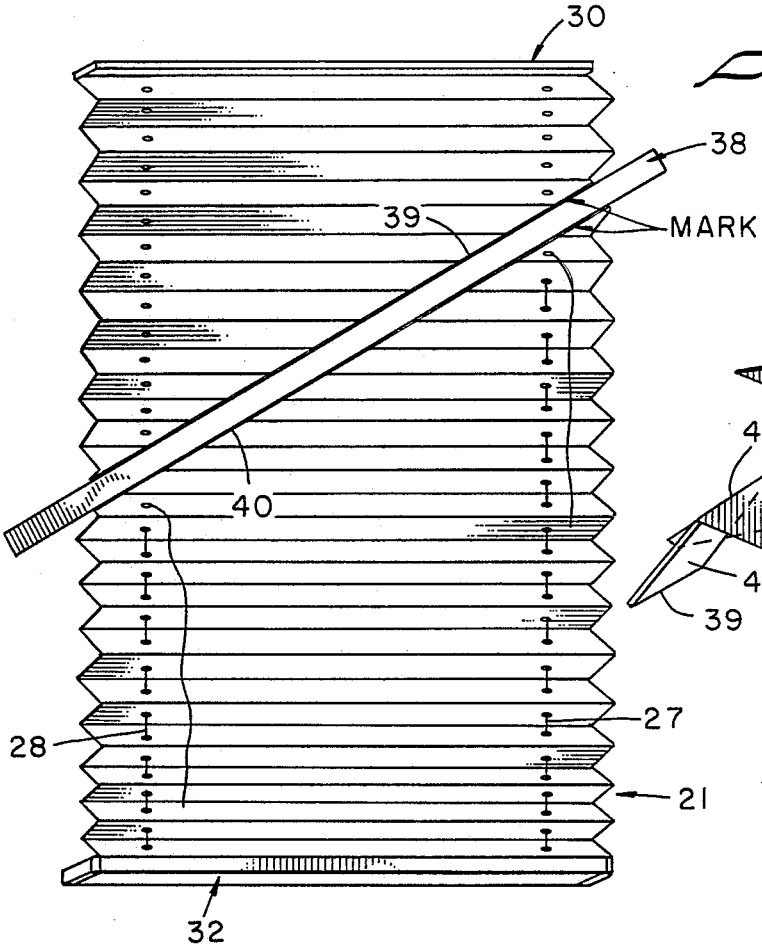
FIG. 6 shows the laying out the cutting angle on the covering unit fabric.

After marking, the shade is removed from the inspection rack and stretched out flat on a smooth, horizontal surface table (not shown) (FIG. 6). Using a straight edge 38 (e.g., approximately one inch wide) the fabric in the area of the angle to be cut between the two marks on the edges is flattened out on the table surface. A first line 39 is drawn joining the two marks L.H. and H.H. and a second line 40 using the opposite side of the straight edge is drawn which is parallel to and approximately one inch (i.e., width of straight edge) from the first line. The fabric is then cut along the first line 39 providing an upper edge to the fabric arranged at the desired predetermined angle.

Figure 8:
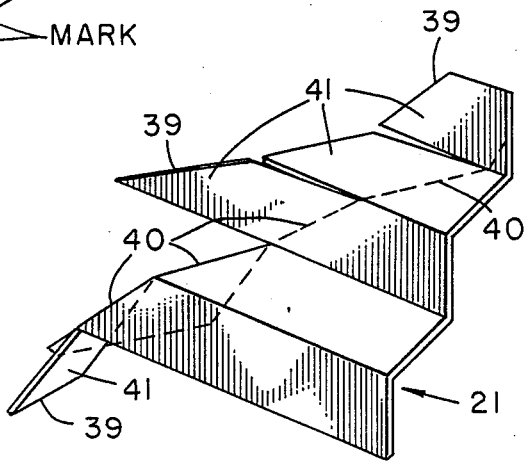
FIG. 8 shows the formation of end tabs on the angularly cut edge of the fabric.
Figure 7:
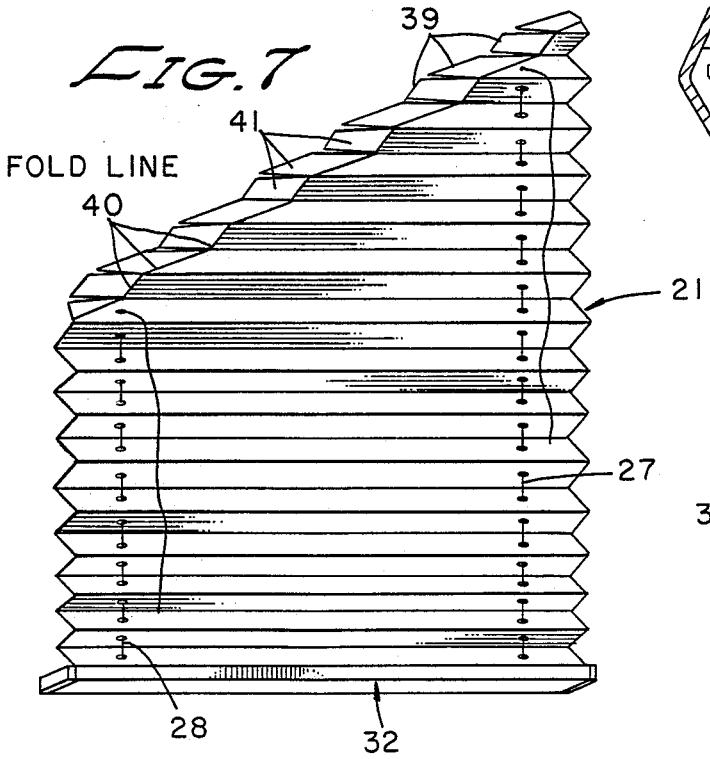
FIG. 7 shows the fabric of FIG. 6 trimmed to the predetermined angular edge.
Figure 11:
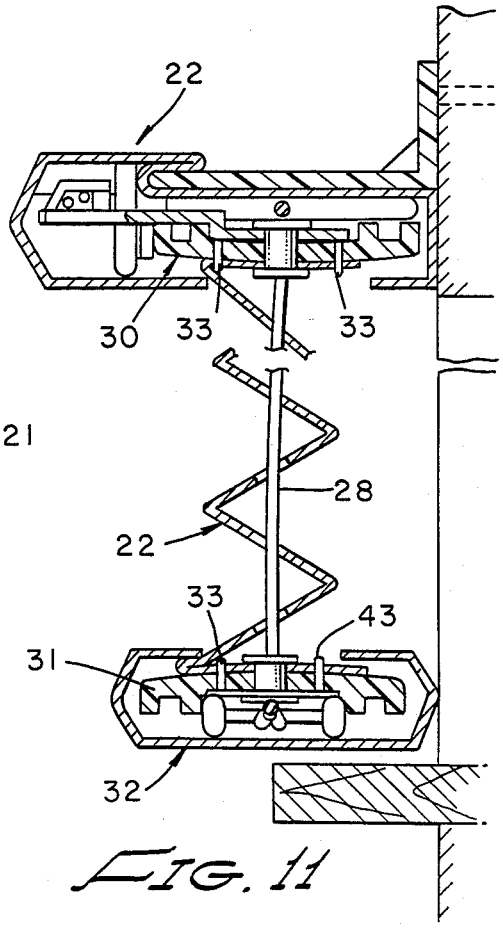
FIG. 11 is a side elevational, sectional view taken along the lines 11—11 of FIG. 1.

Each of the pleat lines is then cut from the outer angled edge 39 to the second line 40 forming tabs 41. Each of the tabs are then folded along the second line 40 in the same direction and are firmly creased (FIGS. 7 and 8).

Starting from what will be the top of the shade upon completion, the tabs 41 of each set of two adjacent pleats may be bent to overlap each other forming a three-sided box pleat and the overlapping tabs are taped together using a small piece of masking tape. Although not strictly a part of the present invention, at this time during normal fabrication of the shade it would be typical to paint the headrail inner rail to the desired rail color.

As shown in FIG. 9, the fabric portion of the shade is then placed on the inner rail against limit stop 44 and the tabs 41 are stapled (43) in place so that the fabric will extend along substantially the center line of the rail. More particularly, the stapling is arranged so as to extend along the centerline axis of the inner rail and in that way insure proper location. When all of the fabric has been stapled to the rail, the tabs are trimmed back slightly from the rail ends as shown in FIG. 10.

The A-frame window covering unit or shade is now complete and can be mounted to a wall as shown in FIG. 1. In use, manipulation of the cord 23 to raise or lower, as the case may be, the pleated fabric 21, the maximum raised position for the fabric being when it is horizontally coincident with the lower end of the angled headrail 22. As already noted there is no raising at any time of the fabric which lies between the upper and lower ends of headrail 22, this fabric maintaining an appearance consistent with the remainder of the fabric as a result of the box-pleat formation (FIG. 9) during fabrication of the predetermined angularly cut fabric edge. That is, in securing the tabs 41 to the angularly disposed rail 22, the tabs are so arranged in relation to each other that when the pleated material is all extended and hanging, it will give a consistent and uniform appearance with no puckering or other distortion.

Although the invention has been described in connection with having the upper rail 22 angularly disposed with respect to a horizontal lower rail 26, these can be reversed and still be within the spirit of the invention. That is, the upper rail may be horizontal and the lower rail angularly oriented, in which case the pleated material would be cut and secured to the lower rail 26 in the same manner as previously described herein for securing to the upper rail.

What is claimed is:

1. A method of making a pleated window covering having an extent of pleated material, a first rail interconnected with a lower edge of the pleated material for generally horizontal disposition and a second upper rail from which the pleated material hangs for arrangement with respect to a wall surface and oriented for disposition at a predetermined angle with respect to the horizontal, comprising the steps of:

laying a length of pleated material onto a horizontal surface, with each pleat being defined by a pair of pleat lines;

securing the first rail to a lower edge of the pleated material;

forming a strip with outer and inner parallel sides on an upper surface of the pleated material, with said strip being arranged at the predetermined angle relative to a pleat line;

severing the pleated material along the outer side of the strip;

severing the pleated material along each pleat line from the outer side of the strip to the inner side of the strip thereby forming a plurality of tabs; and securing the tabs to one surface of the second rail.

2. A method as in claim 1, including the further step of forming the tabs into a sequence of overlapping adjacent pairs of tabs prior to securing the tabs to the second rail.

3. A method as in claim 1, in which the strip is formed by pressing a straight edge with parallel sides onto the pleated material and marking the pleated material along each of the straight edge parallel sides.

4. A method as in claim 1, in which severing of the pleated material is accomplished by cutting.

5. A method as in claim 1, in which the tabs are secured to the second rail by stapling.

* * * * *